US005664330A

United States Patent [19]

DeMars

[11] Patent Number: 5,664,330

[45] Date of Patent: Sep. 9, 1997

[54] DISPOSABLE RAZOR WITH DISPENSER

[76] Inventor: Robert A. DeMars, 5000 N. Parkway Calabasas - Suite 233, Calabasas, Calif. 91302

[21] Appl. No.: 618,034

[22] Filed: Mar. 25, 1996

[51] Int. Cl.[6] ..... B26B 21/44

[52] U.S. Cl. ..... 30/41; 30/539

[58] Field of Search ..... 30/41, 86, 125, 30/50, 96, 535

[56] References Cited

U.S. PATENT DOCUMENTS

| | | | |
|---|---|---|---|
| 1,892,836 | 1/1933 | Harvey . | |
| 2,250,758 | 7/1941 | French | 15/137 |
| 4,476,630 | 10/1984 | Byrne | 30/47 |
| 4,635,361 | 1/1987 | DeMars | 30/41 |
| 4,653,188 | 3/1987 | Kwak | 30/41 |
| 4,716,652 | 1/1988 | Catandella | 30/41 |
| 4,800,649 | 1/1989 | Catandella | 30/41 |
| 5,331,740 | 7/1994 | Carson et al. | 30/41 |

*Primary Examiner*—Douglas D. Watts
*Attorney, Agent, or Firm*—Jack C. Munro

[57] ABSTRACT

A razor having an elongated body within which is contained an internal chamber. The forward end of the internal chamber is closed and is to contain an emollient lotion. The aft end of the internal chamber is to contain a movable slider. Manual movement of the slider is to cause dispensing of the emollient lotion through a dispensing aperture located at the fore end of the elongated body. A shaving head is mounted on the fore end. The aft end of the elongated body is open to provide for easy entry of the emollient lotion and the slider when assembling of the razor.

3 Claims, 2 Drawing Sheets

DISPOSABLE RAZOR WITH DISPENSER

BACKGROUND OF THE INVENTION

1) Field of the Invention

The field of this invention relates to razors for shaving hair of humans and more particularly to a disposable razor where an emollient lotion container is contained within the handle of the razor with this emollient lotion to be dispensed to be applied to the body of the human prior to being shaved.

2) Description of the Prior Art

It is common within the prior art to utilize razors which do not house a shaving lotion therein. Accordingly these razors need a separate shaving lotion container from which is extracted a small quantity of shaving lotion to be applied by the user to the area of the body that is to be shaved prior to initiating of the shaving operation with the razor.

It has been known in the past to incorporate an emollient lotion container within the body of the razor. Some of the prior art razors have actually incorporated an emollient lotion tube within the handle of the razor with the body of this tube to be compressed by a manually operated device which will cause dispensing of the emollient lotion from the tube. These kind of razors are relatively complex in construction since such require the addition of the emollient lotion tube plus the mechanism for dispensing from the tube.

It has also been known within the prior art to place the emollient lotion within the handle of the razor thereby eliminating the tube. This is a more desirable arrangement in that it uses fewer parts. However, these type of razors have not been constructed in a manner that facilitates their manufacture, assemblage and dispensing so as to minimize manufacturing cost. It is normally preferred that such razors be constructed to be disposable with the intent to dispose of the razors after two or three uses. Because of the disposable nature of such razors, cost is an exceedingly important factor. If the razor cannot be manufactured and sold relatively inexpensively, then such razors will not enjoy widespread usage.

SUMMARY OF THE INVENTION

The design of the present invention includes an elongated body which is to function as the handle for the razor. The shaving head is to be attached to the fore end of the elongated body. The elongated body includes a bore in the form of an internal chamber with the fore end of the internal chamber to contain an emollient lotion. A slider is movably mounted within the internal chamber with the fore end of the slider including a plunger which is to apply pressure to the emollient lotion and cause such to be dispensed through a dispensing aperture formed within the elongated body. After the emollient lotion is inserted into the internal chamber during assemblage, the slider is then inserted through an open aft end of the internal chamber when assembling of the slider to the elongated body. The quantity of emollient lotion contained within the internal chamber is generally sufficient for two to three shaves by a human with that human shaving a part of the human's body such as face or legs.

The primary objective of the present invention is to provide an improved self contained razor which includes a quantity of shaving lotion within the body of the razor.

Another objective of the present invention is to construct a razor with few parts which can be manufactured inexpensively and assembled quickly and easily by unskilled labor thereby minimizing the overall manufacturing cost of the razor of the present invention.

DETAILED DESCRIPTION OF THE PREFERRED EMBODIMENT

Figure 1:
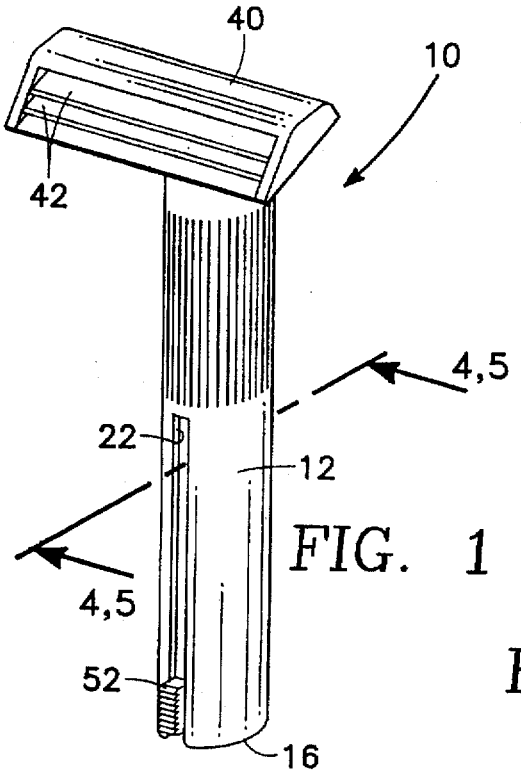
FIG. 1 is a frontal isometric view of the razor constructed in accordance with this invention.
Figure 2:
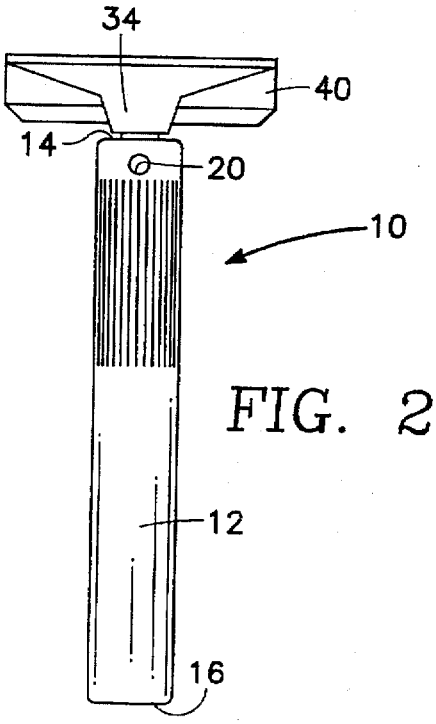
FIG. 2 is a rear view of the razor of the present invention.

Referring particularly to the drawings, there is shown the razor 10 of this invention. The razor 10 is comprised of an elongated body 12. The elongated body 12 is cylindrical and terminates in a closed fore end 14 and an open aft end 16. Formed within the elongated body 12 is an internal chamber 18.

Formed through the sidewall of the elongated body 12 directly adjacent the fore end 14 is a dispensing aperture 20. The dispensing aperture 20 connects with the internal chamber 18. Also formed within the elongated body 12 is an elongated slot 22. The length of the elongated slot 22 is approximately one-half of the total length of the elongated body 12. The length of the elongated body 12 is selected to be generally in the range of about four to five inches in length which is a convenient length to facilitate its being grasped and used by a human user. The elongated slot 22 will generally be in the range of two to two and one-half inches long. The forward end of the internal chamber 18, which does not include elongated slot 22, will provide adequate volume to contain a desirable amount of emollient lotion 44. The amount of emollient lotion 44 will generally be sufficient for between two to three separate shaves by the razor 10. However, it is considered within the scope of this invention that the actual number of shaves to be obtained using the razor 10 is deemed to be according to an individuals usage requirement.

Elongated slot 22 is open at the open aft end 24. Surrounding the open aft end 24 is an annular bead 26 which is formed on the interior wall surface of the elongated body 12 and is directly adjacent the wall surface of the internal chamber 18. Fixedly mounted on the fore end 14 and exteriorly located of the elongated body 12 is a polygonal shaped pin 28. The outer end of the polygonal shaped pin 28 is formed into a lip 30. The polygonal shaped pin 28 and lip 30 is to be inserted within hole 32 of a polygonal shaped socket 34. The size of the hole 32 in relation to the lip 30 is such that the lip 30 must be forcibly inserted through the hole 32 and, upon the lip 30 reaching the enlarged hole 36, the lip 30 will then rest on ledge 38. This will result in the shaving head 40 being fixedly locked onto the pin 28 and is fixed relative to the elongated body 12. Shaving head 40 would normally include at least one blade with two in number of the blades 42 being preferable.

It is to be noted that the pin 28 is of a polygonal shape. This will prevent the shaving head 40 from rotating on the pin 28. It is desired to not have any relative rotation of the shaving head 40 relative to the elongated body 12. It is to be understood that all parts of the razor 10 of this invention (blades 42 excepted) will normally be constructed of plastic.

The emollient lotion 44 is placed within the foreword portion of the internal chamber 18 completely filling such with the level of the emollient lotion 44 almost aligning with the closed end of the elongated slot 22. A slider 46, which has a cupped shaped plunger 48 located at its forward end, at time of assembly is inserted through the open aft end 24 within the internal chamber 18. The cup-shaped plunger 48 will generally be constructed of a deflectable plastic material and will be continually biased outwardly against the wall of the internal chamber 18. The cup shaped plunger 48 assures a close fit with the internal chamber 18. Generally the internal chamber 18 will be cylindrical with the cup-shaped plunger 48 being circular in its transverse dimension. The aft end of the slider 46 is formed into a circular-shaped disc 50. Directly adjacent the circular-shaped disc 50 and extending laterally outward from the body of the slider 46 is a handle 52. The handle 52 rides within the slot 22.

Figure 3:
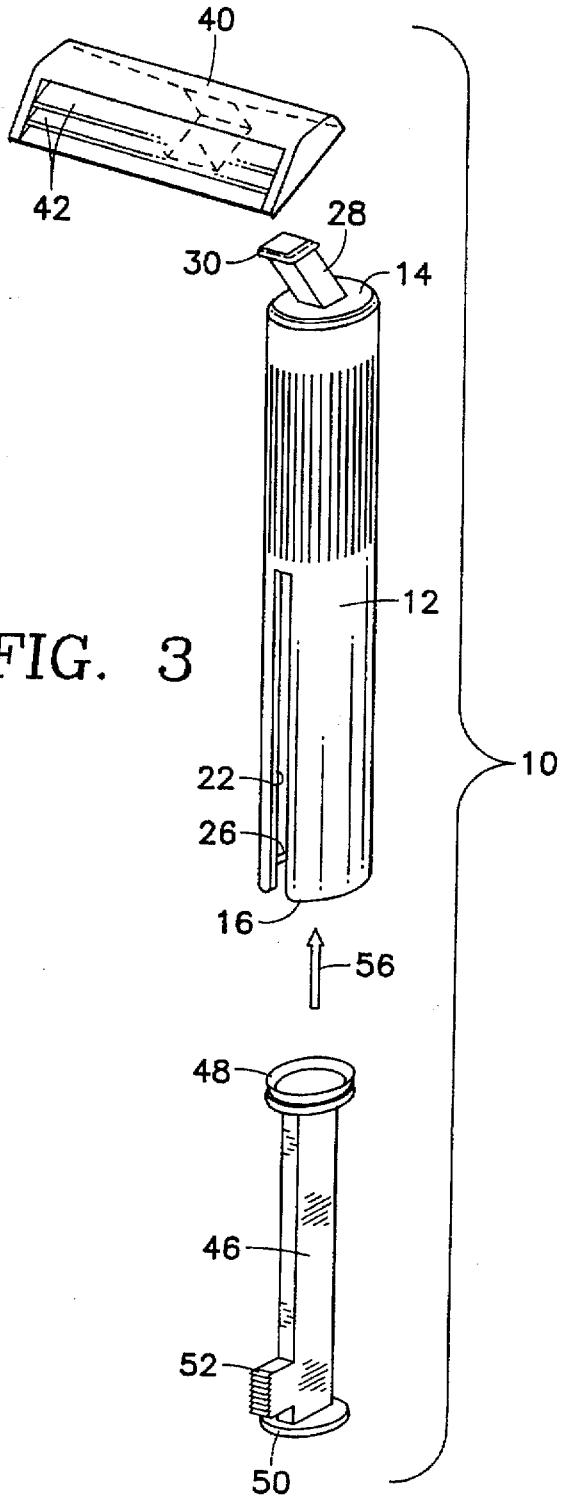
FIG. 3 is an exploded isometric view showing the different parts that make up the construction of the razor of the present invention.
Figure 4:
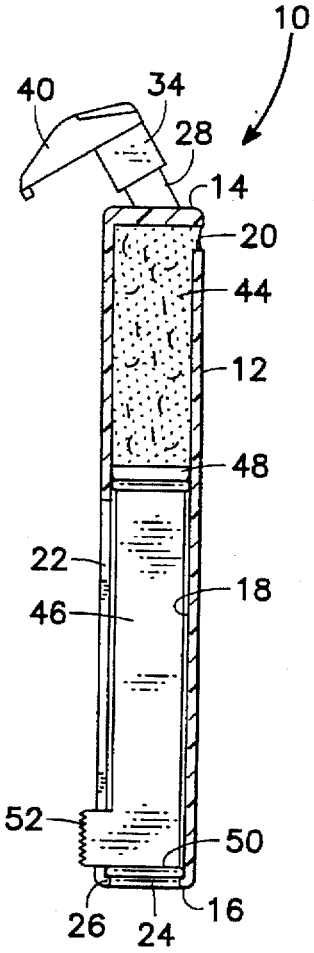
FIG. 4 is a longitudinal sidecross-sectional view taken along cut away line 4—4 of FIG. 1 through the elongated body of the razor of the present invention showing the slider in its retracted position which is used to dispense the emollient lotion from the razor of the present invention.
Figure 5:
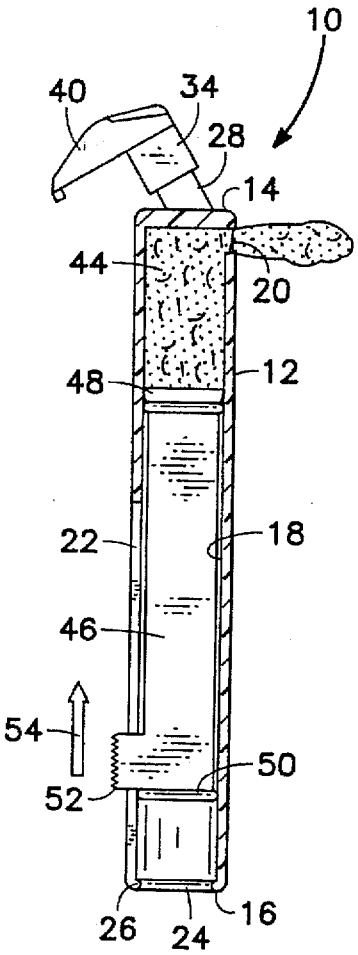
FIG. 5 is a cross-sectional view similar to FIG. 4 taken along cut away line 5—5 of FIG. 1 but showing the slider in a movement position that would result in dispensing of emollient lotion.
Figure 8:
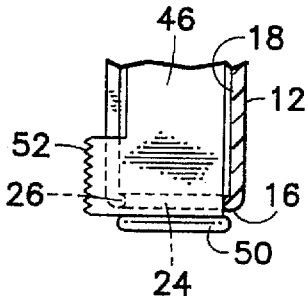
FIG. 8 is a cross-sectional view of the aft end section of the razor of the present invention showing the slider in a position before insertion within the internal chamber formed within the elongated body.
Figure 9:
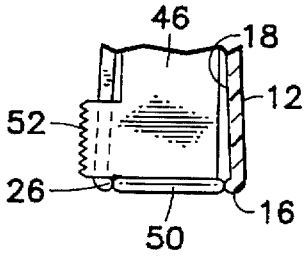
FIG. 9 is a view similar to FIG. 8 with the slider in a partially inserted position within the internal chamber.
Figure 10:
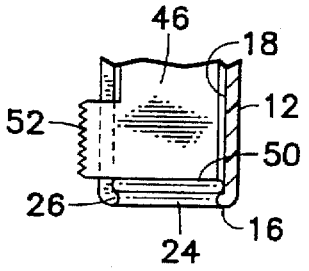
FIG. 10 is a view similar to FIG. 9 but showing the slider completely inserted in the retracted position within the internal chamber of the elongated body with the slider in the position shown in FIG. 4.
Figure 6:
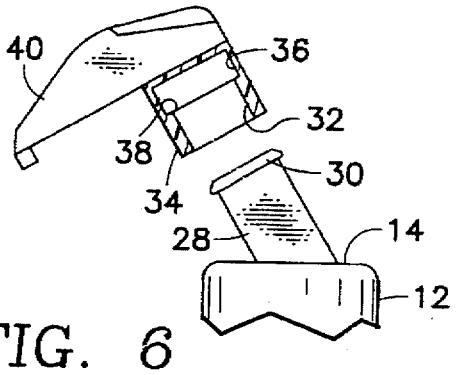
FIG. 6 is an exploded view, partly in cross-section, of the shaving head section of the razor of the present invention showing the shaving head in a disconnected state from the elongated body of the razor.
Figure 7:
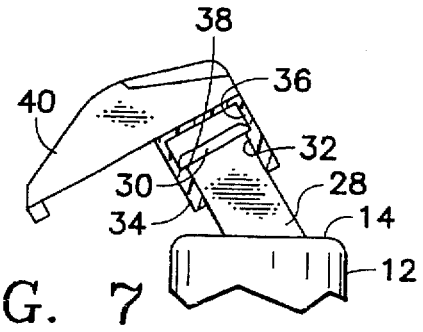
FIG. 7 is a view similar to FIG. 6 but showing the shaving head being secured to the elongated body.

The interior annular bead 26 is slightly smaller in diameter than the plunger 48 and the circular-shaped disc 50. The plunger 48 and the circular-shaped disc 50 are about the same diameter. Insertion of the slider 46 into the internal chamber, as is depicted by arrow 56 in FIG. 3, will result in the plunger 48 being forced over the annular bead 26. The same forcing occurs for the circular shaped disc 50 as it is moved over the annular bead 26. The deflection of the aft end of the elongated body 12 during this forcing over procedure is depicted in FIG. 9. Once the circular-shaped disc 50 is located within the internal chamber 18, the aft end of the elongated body 12 will move back to its original position as is shown clearly in FIG. 10. It is the function of the circular-shaped disc 50 to keep the handle 52 aligned within the elongated slot 22 and keeps the handle 52 from skewing within the slot 22. The handle 52 is maintained in the same position in alignment with the slot 22 during the entire time that the slider 46 is to be moved within the internal chamber 18. Movement of the slider 46 within the internal chamber 18 is depicted generally by the arrow 54. It is to be understood that the slider 46 can move until the plunger 48 will be located directly in alignment with the dispensing aperture 20. At that time, the emollient lotion 44 will be completely removed from the internal chamber 18 and the razor 10 will most likely be disposed of with a new razor 10 to be utilized by the user.

It is to be understood that manual movement of the slider 46 is accomplished by the user placing his or her thumb against the handle 52 and physically force the slider 46 against the emollient lotion 44. This will cause some of the emollient lotion 44 to be ejected through dispensing opening 20. Once the desired amount of emollient lotion 44 has been dispensed, movement of handle 52 is stopped and the user is to apply that lotion to the area that is to be shaved by the razor 10.

An important aspect of this invention is that there are only three parts, the elongated body 12, the shaving head 40 and the slider 46. These three parts make up the entire razor 10. These parts can be merely connected together in a very rapid manner which will produce the razor 10 of this invention. The emollient lotion 44 will be inserted within the internal chamber 18 prior to insertion of the slider 46. As the slider 46 is inserted into the internal chamber 18, air from internal chamber 18 is allowed to escape through the slot 22. It is desired that the emollient lotion 44 be located directly adjacent the closed end of the elongated slot 22 which would mean that when the plunger 48 comes into the contact with the emollient lotion 44 that there is no longer any air located between the emollient lotion 44 and the plunger 48. This will therefore provide for a smooth dispensing operation of the emollient lotion 44 from the dispensing opening 20.

What is claimed is:

1. A razor comprising:

an elongated body having a fore end and an aft end, said fore end being closed by a closing wall, said aft end being open defining an open aft end, said elongated body having an internal chamber, said internal chamber having a sidewall, said internal chamber to contain an emollient lotion in the portion of said internal chamber located directly adjacent said fore end, a dispensing aperture formed in said elongated body directly adjacent said fore end, said dispensing aperture connecting with said internal chamber, said dispensing aperture adapted to dispense said emollient lotion into the ambient;

a shaving head mounted by mounting means to said elongated body at said fore end; and a slider movably mounted in said internal chamber, said slider being elongated, said slider having a forward end and a rear end, said slider being movable between a retracted position and an extended position, said slider having a plunger at said forward end forming a close fit with said internal chamber, said plunger being constructed of a deflectable material, said deflectable material being biased outwardly against said sidewall, handle means connected to said slider at said rear end, manual movement of said slider by said handle from said retracted position to said extended position will cause said emollient lotion to be dispensed through said dispensing aperture, said handle riding within an elongated slot formed in said elongated body, said elongated slot terminating in an open end and a closed end, said open end located at said open aft end, said closed end located between said open aft end and said closing wall, said slider to be inserted into said internal chamber through said open aft end at time of assembly.

2. The razor as defined in claim 1 wherein:

said open aft end including an interior annular bead, said slider to be forcibly inserted past said interior annular bead preventing disengagement of said slider from said internal chamber once said slider is located within said internal chamber.

3. The razor as defined in claim 1 wherein:

said slider having a disc, said disc being located at said rear end, said disc assuming a close fit with said internal chamber, said disc to keep said slider properly aligned within said internal chamber as said slider moves within said internal chamber.

* * * * *